US009923254B2

(12) United States Patent
Haeupler

(10) Patent No.: US 9,923,254 B2
(45) Date of Patent: Mar. 20, 2018

(54) RADIO-FREQUENCY BLOCKING FILTER

(71) Applicant: KATHREIN-AUSTRIA GES.M.B.H., Niederndorf (AT)

(72) Inventor: Wolfgang Haeupler, Rosenheim (DE)

(73) Assignee: Kathrein-Austria Ges.m.b.H., Niederndorf (AT)

( * ) Notice: Subject to any disclaimer, the term of this patent is extended or adjusted under 35 U.S.C. 154(b) by 284 days.

(21) Appl. No.: 14/442,729

(22) PCT Filed: Nov. 14, 2013

(86) PCT No.: PCT/EP2013/003438
§ 371 (c)(1),
(2) Date: May 14, 2015

(87) PCT Pub. No.: WO2014/075805
PCT Pub. Date: May 22, 2014

(65) Prior Publication Data

US 2015/0303543 A1 Oct. 22, 2015

(30) Foreign Application Priority Data

Nov. 15, 2012 (DE) ..... 10 2012 022 433

(51) Int. Cl.
*H01P 5/12* (2006.01)
*H01P 1/202* (2006.01)
(Continued)

(52) U.S. Cl.
CPC ..... *H01P 1/202* (2013.01); *H01P 1/2053* (2013.01); *H01P 7/04* (2013.01)

(58) Field of Classification Search
CPC ..... H01P 1/202; H01P 1/2053; H01P 7/04
(Continued)

(56) References Cited

U.S. PATENT DOCUMENTS 4,268,809 A 5/1981 Makimoto et al.
4,276,525 A 6/1981 Nishikawa et al.
(Continued)

FOREIGN PATENT DOCUMENTS

EP 0508812 A1 * 10/1992 ..... H01P 1/2056
EP 0 576 273 12/1993
(Continued)

OTHER PUBLICATIONS

International Search Report for PCT/EP2013/003438, dated Jan. 29, 2014, three pages.
(Continued)

*Primary Examiner* — Robert J Pascal
*Assistant Examiner* — Kimberly Glenn
(74) *Attorney, Agent, or Firm* — Nixon & Vanderhye P.C.

(57) ABSTRACT

A radio-frequency filter comprises an input terminal and an output terminal. A signal line is galvanically connected or capacitively coupled firstly to the input terminal and secondly to the output terminal. The signal line, with the formation of a capacitive inner conductor and/or resonator coupling, runs past the relevant inner conductor through the resonators of the radio-frequency blocking filter. The signal line has at least one galvanic isolation location in the form of a capacitive isolation location. The capacitive isolation location is spaced apart from the inner conductors and capacitively coupled thereto. The resonators and/or the inner conductors capacitively coupled to the signal line.

21 Claims, 5 Drawing Sheets

(51) Int. Cl.
*H01P 1/205* (2006.01)
*H01P 7/04* (2006.01)

(58) Field of Classification Search
USPC ..... 333/134
See application file for complete search history.

(56) References Cited

U.S. PATENT DOCUMENTS 5,329,687 A * 7/1994 Scott ..... H01P 1/205
29/527.2
5,783,978 A 7/1998 Noguchi et al.
6,366,184 B1 4/2002 Ohtonen

FOREIGN PATENT DOCUMENTS

| | | |
|---|---|---|
| EP | 0 825 710 | 2/1998 |
| GB | 2 234 399 | 1/1991 |
| JP | 2006332959 A * | 12/2006 |
| WO | WO 2006/029868 | 3/2006 |

OTHER PUBLICATIONS

Written Opinion (non-English) of the ISA for PCT/EP2013/003438, dated Jan. 29, 2014, six pages.
English translation of the International Preliminary Report on Patentability and Written Opinion of the International Searching Authority dated May 28, 2015, issued in corresponding International Application No. PCT/EP2013/003438.

* cited by examiner

RADIO-FREQUENCY BLOCKING FILTER

This application is the U.S. national phase of International Application No. PCT/EP2013/003438 filed 14 Nov. 2013 which designated the U.S. and claims priority to German Patent Application No. 10 2012 022 433.8 filed 15 Nov. 2012, the entire contents of each of which are hereby incorporated by reference.

The invention relates to a radio-frequency blocking filter of a coaxial construction in accordance with the preamble of claim 1.

In radio systems, in particular in the field of mobile communications, a shared antenna is often used for transmitted and received signals. The transmitted and received signals each use different frequency ranges, and the antenna has to be suitable for transmitting and receiving in the two frequency ranges. Therefore, to separate the transmitted and received signals, suitable frequency filtering is required, by means of which on the one hand the transmitted signals can be passed from the transmitter to the antenna and on the other hand the received signals can be passed from the antenna to the receiver. Nowadays, radio-frequency filters of a coaxial construction are used for splitting up the transmitted and received signals.

For example, a pair of radio-frequency filters may be used, which both make a particular frequency band possible (band-pass filters). Alternatively, a pair of radio-frequency filters may be used, which both stop a particular frequency band (band-stop filters). Further, a pair of radio-frequency filters may be used, of which one filter allows through frequencies below a frequency between the transmission and receiving band and stops frequencies above this frequency (deep-pass filter), and the other filter stops frequencies below a frequency between the transmission and receiving band and allows through frequencies above this frequency (high-pass filter). Further combinations of these filter types are also conceivable.

Radio-frequency filters are often constructed from coaxial resonators, since they consist of milled or cast parts, making them simple to manufacture. These resonators further ensure a high electrical quality and a relatively high temperature stability.

A radio-frequency filter known in the art comprises an input terminal and an output terminal, which are galvanically interconnected via a connection line. The radio-frequency filter further comprises at least two coaxial resonators, which are each capacitively coupled to the connection line, in such a way that the resonators are also capacitively coupled to the input terminal and the output terminal. The coupling points of the resonators to the connection line have to be at a distance on the connection line of a quarter of the wavelength of the average-frequency signal to be filtered by the radio-frequency filter, in such a way that the individual resonators are coupled together resonantly.

E-GSM signals used in mobile communications use the frequency range of 880-915 MHz for uplink and the frequency range of 925-960 MHz for downlink. As a result of television programmes transmitted in analogue via satellite becoming obsolete, the "digital dividend" in the frequency range of 790-862 MHz is available for mobile communications. In this context, the frequency band of 791-821 MHz is used for uplink, whilst the frequency band of 832-862 MHz is used for downlink.

A radio-frequency filter is known for example from U.S. Pat. No. 4,276,525. This is a conventional band-pass filter, in which capacitive coupling elements from an input to an output are provided at the free ends of the internal conductors (which are formed as coaxial resonators). Therefore, in band-pass filters of this type the signal transmission takes place directly via the resonators, in other words the resonant frequencies are within the useful frequency range.

A similar prior art may also be taken from U.S. Pat. No. 6,366,184 B1. This document also discloses a radio-frequency band-pass filter comprising a plurality of resonators positioned side by side, in which the individual resonators are coupled together by way of different additional coupling devices, for example in the form of coupling wires.

Finally, the same also applies to the radio-frequency band-pass filter previously known from U.S. Pat. No. 4,268,809. In this case too, a series of line members are provided across the resonators so as to form a capacitive transmission path.

By contrast with the aforementioned band-pass filters, blocking filters are also known, which—if they are of a coaxial construction like the aforementioned filters—conventionally comprise a plurality of coaxial resonators coupled together, a signal line extending from an input to an output adjacent to the internal conductors of these resonators. In blocking filters of this type, the smaller the blocking frequency, the longer the signal line between two mutually adjacent resonators has to be. Among other reasons, this is because the length of the signal line between two resonators is often supposed to be a quarter of the wavelength of the blocking frequency. For a signal having a frequency of 790 MHz, a quarter of this wavelength is 0.1 m. In a radio-frequency filter, the distance between two internal conductors of two adjacent resonators is usually approximately 2 cm to 3 cm, and so the approximately 10 cm long connection paths between mutually adjacent resonators often have to be folded in a complex manner. A radio-frequency filter constructed in this manner is complex and expensive to produce.

Starting from the generic prior art, the object of the present invention is to provide an improved, simpler radio-frequency filter in the form of a radio-frequency blocking filter, which does not require any complex laying of a connection line through the radio-frequency blocking filter and can thus be provided compactly and cost-effectively.

The object is achieved according to the invention by way of the features specified in claim 1. Advantageous embodiments of the invention are specified in the dependent claims.

As stated, and as is known, a radio-frequency blocking filter differs from a radio-frequency band-pass filter in terms of the signal transmission path thereof.

In a radio-frequency band-pass filter, the signal transmission path goes directly via the resonators. This means that the resonant frequencies are within the useful frequency range of the radio-frequency filter. In other words, the resonators oscillate at the frequencies which are to be transmitted.

By contrast, radio-frequency blocking filters have a completely different signal transmission path. In radio-frequency blocking filters, the useful signal is transmitted via a separately provided line, which in the art conventionally extends continuously from an input to an output of the blocking filter. In addition, it is provided that this connection line, also referred to in the following as a signal line, is capacitively coupled by approaching the resonators, in other words approaching the internal conductors of the capacitive resonators. In this case, the resonators thus oscillate at a frequency outside the transmission frequency range to be transmitted via the connection line.

In particular at low frequencies, however, this requires a comparatively long connection line, meaning that the radio-frequency filter also has to be of a considerable size.

This is where the invention comes in.

The invention proposes that the connection line or signal line, which is continuous in a radio-frequency blocking filter in the art, should now have at least one or more galvanic separation points, which are formed as capacitive separation points in this line. These capacitive separation points are additionally capacitively coupled to individual resonators. This makes possible a considerable reduction in the size of corresponding radio-frequency blocking filters of a coaxial construction. This is because the galvanic separation points in the form of the aforementioned coupling capacitor make a phase shift of the signal on the connection line possible, said phase shift corresponding in terms of effect to a shortened continuous connection line.

In other words, the invention thus comprises a signal line which extends through the radio-frequency blocking filter and which is provided with at least one or more galvanic separation points (in accordance with the number of resonators), the resonators being interconnected by means of a coupling capacitor, in each case arranged at the separation point and connected to the connection line by two free ends. Therefore, the term "capacitive separation points" is also sometimes used.

The signal line therefore comprises two line portions galvanically separated from one another. In the equivalent circuit diagram of the corresponding radio-frequency filter, the input terminal and the output terminal are interconnected by way of the coupling capacitor arranged between the line portions.

The respective resonators are capacitively coupled to the signal line, and thus to the input terminal and the output terminal, in that the signal line in each case comprises a further coupling face in the region of the respective internal conductor of the respective resonators.

In the art, radio-frequency blocking filters of this type are of a comparatively large construction. A large construction of a filter of this type is also necessary for achieving a high quality and a high attenuation. The distance between the individual domes, in other words the adjacent internal conductors of two adjacent resonators, has to be of a particular size, in such a way that the signal lines passing the two adjacent domes are also of an appropriate size for generating a particular radio-frequency blocking frequency. This is where the invention comes in, providing in contrast a highly miniaturised solution.

As a result of the at least two resonators being connected by the coupling capacitor, the length of the signal line between the coupling points of the at least two resonators and the signal line can, as stated, be shortened, since the coupling capacitor leads to a phase shift in the signal to be filtered, the phase shift in the signal having the same effect as transmitting the signal to be filtered via a connection line of a corresponding length, in other words a signal line of a corresponding length.

Thus, as a result of the resonators being connected in accordance with the invention via the coupling capacitor arranged at the separation point of the connection line, not only can the length of the required signal line be reduced, but the radio-frequency blocking filter according to the invention can also be produced in a very compact yet simple and thus cost-effective manner.

In the radio-frequency blocking filter according to the invention, the internal conductors extend from the housing base preferably vertically towards the housing cover.

Further, in the radio-frequency blocking filter according to the invention, the internal conductors are preferably in the form of internal conductor tubes. As a result, it is possible for a tuning element to be introduced into the correspondingly formed cavity of the internal conductor tube at a variable distance, in such a way that the radio-frequency filter can be tuned.

Preferably, the connection line comprises at least two line portions which are galvanically separated from one another at the separation point of the connection line. In this case, a first line portion is galvanically connected and/or capacitively coupled to the input terminal and comprises a first coupling face, and a second line portion is galvanically connected and/or capacitively coupled to the output terminal and comprises a second coupling face. The first coupling face and the second coupling face are positioned opposing one another at least in part, in such a way that the first coupling face and the second coupling face form the coupling capacitor.

A radio-frequency filter of a corresponding construction is particularly simple in construction. The coupling faces of the respective line portions can be orientated in parallel with the longitudinal extent of the radio-frequency filter and in parallel with the vertical extent of the respective internal conductor of the resonators. This makes the geometry of a radio-frequency filter of a corresponding construction particularly simple. The size of the respective coupling faces of the respective line portions can be adapted in a very simple manner, by simply replacing the corresponding line portions, the line portions comprising coupling faces of a size adapted to the requirements at the respective ends thereof.

Preferably, the line portions are arranged in parallel and so as to be mutually offset and the first coupling faces and the second coupling faces are arranged in parallel and so as to be mutually offset. As a result, the respective coupling faces can be positioned with respect to one another in a particularly simple manner. Further, the distance of the coupling faces from one another can be set in a simple manner.

Preferably, a partition wall comprising a dielectric material is arranged between the first coupling face and the second coupling face.

In a radio-frequency filter of a corresponding construction, the capacitance of a correspondingly formed coupling capacitor can be influenced by way of the selection of the dielectric material.

Preferably, the radio-frequency filter further comprises a holding and/or receiving device, which is braced against the internal conductor and/or can be fixed to the internal conductor and which comprises two pouch-like receiving spaces, which are separated from one another by a partition wall. The first coupling face is arranged in a first receiving space of the holding and/or receiving device, and the second coupling face is arranged in a second receiving space of the holding and/or receiving device.

As a result of a holding and/or receiving device of this construction being provided, it is particularly simple to fix the respective line portions to the internal conductor. Further, it is particularly simple to arrange the respective line portions and thus the respective coupling faces with respect to one another by way of the holding and/or receiving device, since the corresponding coupling faces simply have to be introduced into the receiving spaces or receiving pouches provided therefor in the holding and/or receiving device. The holding and/or receiving device may simply be braced on the respective internal conductors of the resonators, or alternatively, it is also possible for the holding and/or receiving device to be connected or fixed to the internal conductors for example by gluing.

Preferably, the respective second coupling faces of the line portions are arranged opposing the respective internal conductors, in such a way that the respective resonators are capacitively coupled to the respective line portions. A support wall of the holding and/or receiving device is arranged between the respective second coupling faces and the respective internal conductors.

As a result of a corresponding arrangement of the respective second coupling faces of the line portions, the capacitive coupling of the resonators to the respective line portions is achieved in a particularly simple manner in terms of construction. Further, by way of the selection of the material of the supporting wall, which is arranged between the internal conductors and the second coupling faces, the capacitive coupling between the coupling faces and the internal conductors can be adapted.

Preferably, the radio-frequency filter further comprises a further terminal. This further terminal may also be referred to as a transceiver terminal. The further terminal is arranged between the input terminal and the output terminal and is galvanically connected to the connection line. The further terminal is arranged between coupling points of the resonators to the connection line.

As a result of the radio-frequency filter being constructed in this manner, with an appropriate configuration of the resonators it can form a duplex filter. In this context, the input terminal may be provided for a transmitter, whilst the output terminal may be provided for a receiver. The further terminal or the transceiver terminal may in this case be connected to an antenna which is provided and formed for transmitting and receiving signals.

Preferably, at least two resonators are capacitively coupled to the connection line between the further terminal and the input terminal. Further, at least two resonators are likewise capacitively coupled to the connection line between the further terminal and the output terminal.

As a result of the radio-frequency blocking filter being configured in this manner, it can have a high attenuation over a wide frequency range, meaning that the radio-frequency blocking filter constructed in this manner can block a wider frequency range.

Preferably, the radio-frequency blocking filter according to the invention operates in the range between 790 MHz and 862 MHz and/or in the range between 880 MHz and 960 MHz and/or in the range of the 1800 MHz mobile radio frequency and/or the 2000 MHz mobile radio frequency.

In the following, the invention is described in greater detail by way of drawings, in which, in detail:

Figure 1:
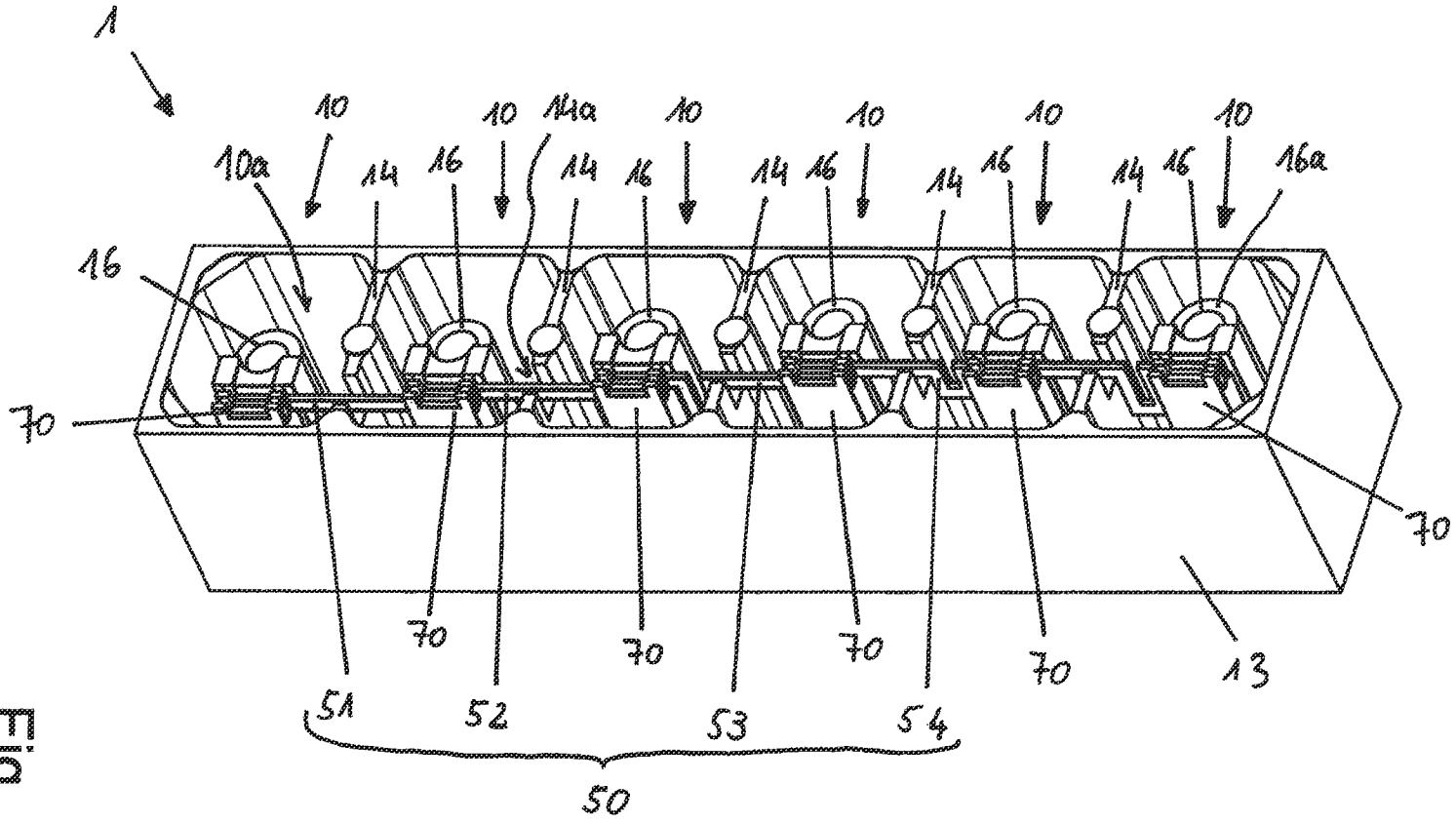
FIG. 1 is a three-dimensional drawing of a radio-frequency blocking filter according to the invention with the housing cover removed.
Figure 3:
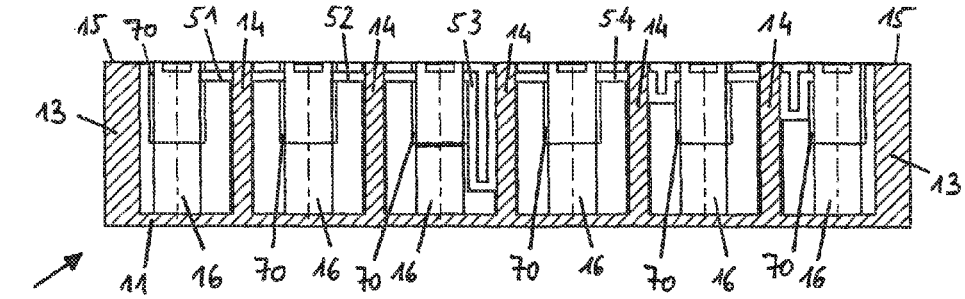
FIG. 3 is a side view of the radio-frequency blocking filter shown in FIGS. 1 and 2, sectioned along the section plane P-P of FIG. 2.
Figure 2:
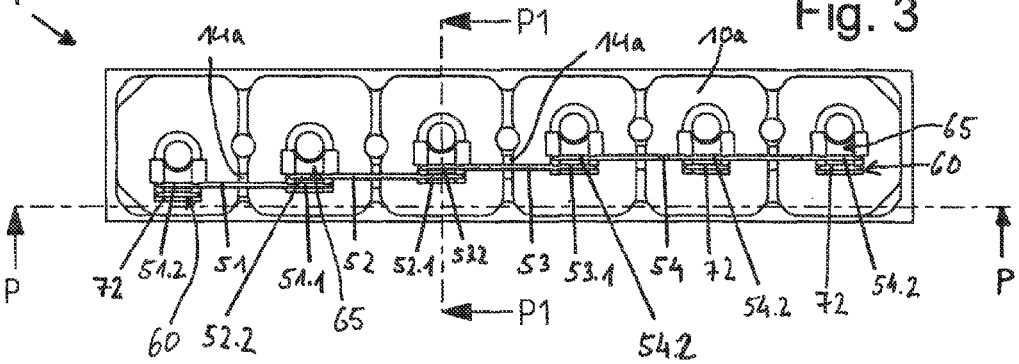
FIG. 2 is a plan view of the radio-frequency blocking filter shown in FIG. 1.
Figure 4A:
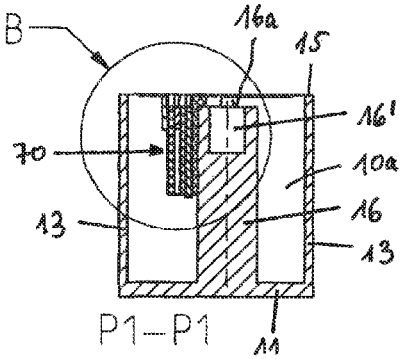
Figure 4B:
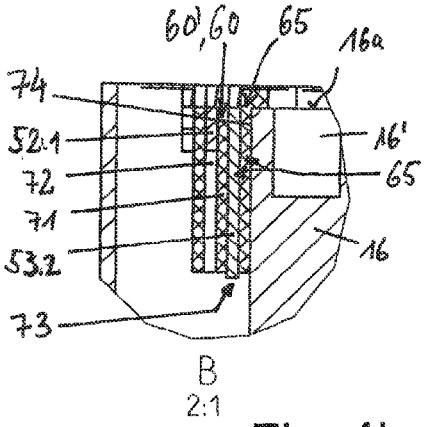

FIG. 4*a* is a side view of the radio-frequency blocking filter shown in FIGS. 1 to 3, sectioned along the section plane P1-P1 of FIG. 2;

FIG. 4*b* is an enlargement of the region of the radio-frequency blocking filter outlined in FIG. 4*a;*

Figure 5:
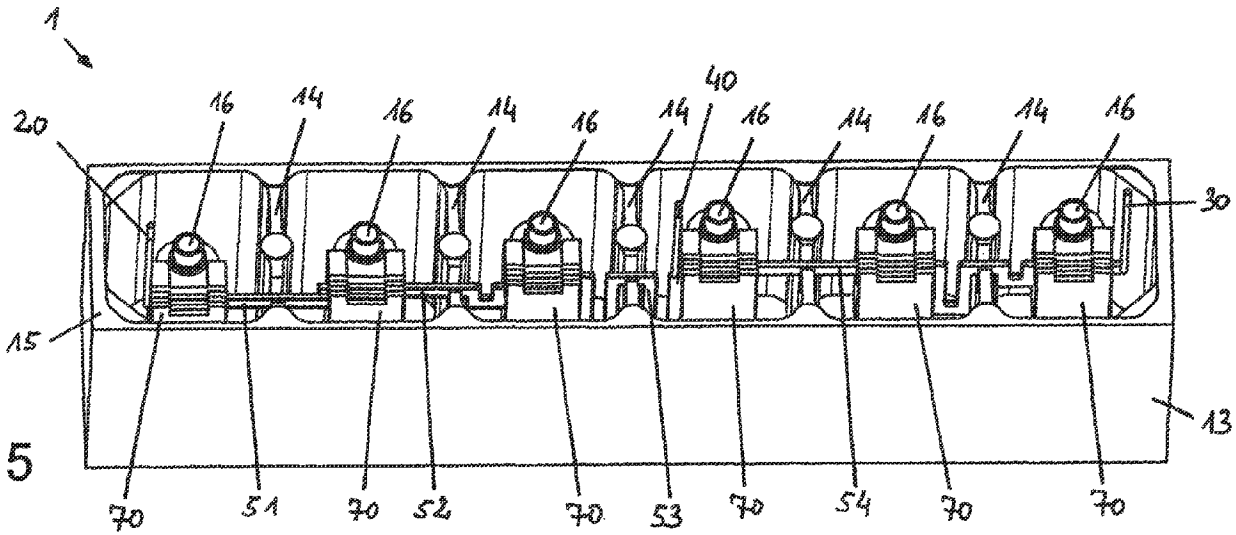
Figure 6:
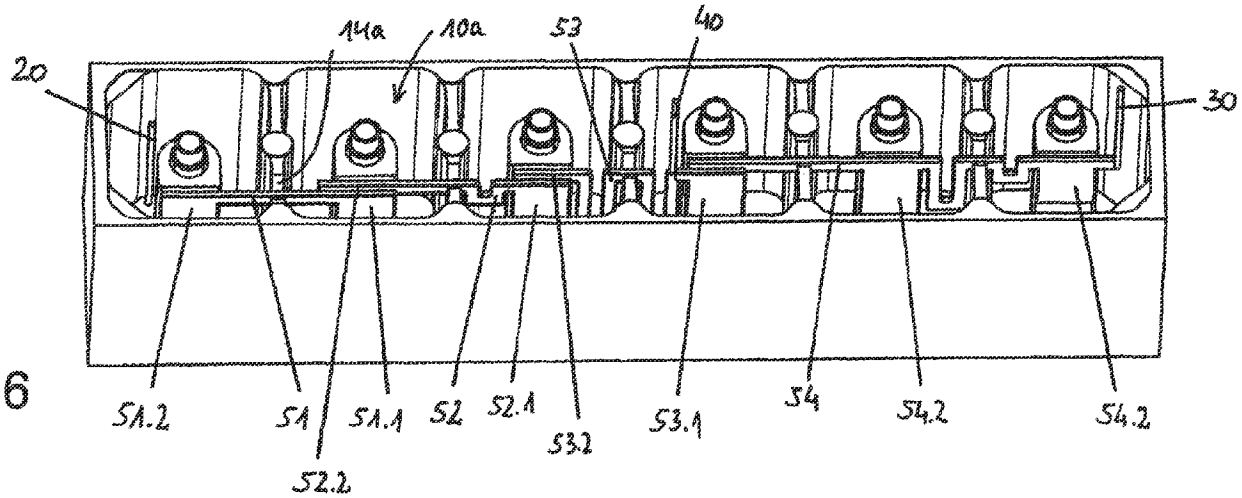
Figure 7:
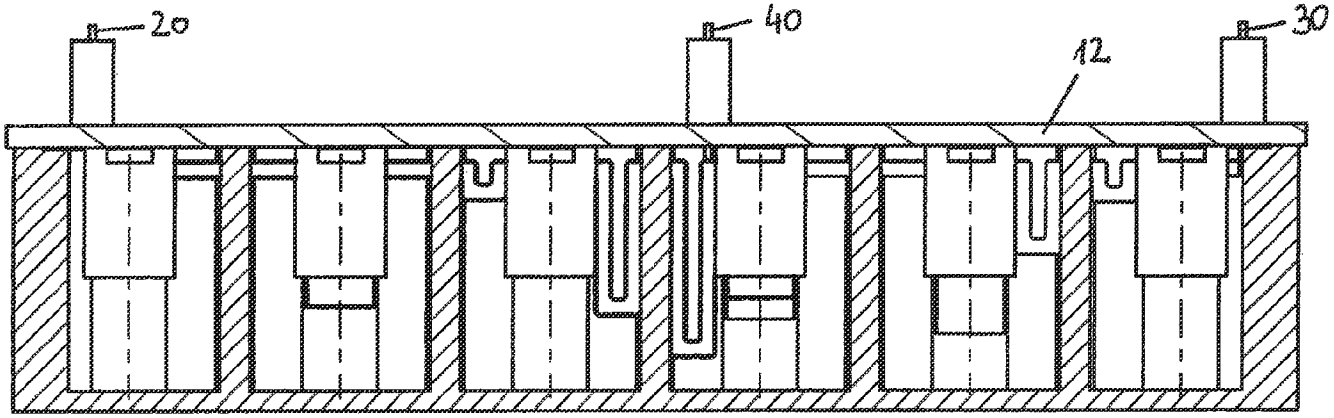
Figure 8:
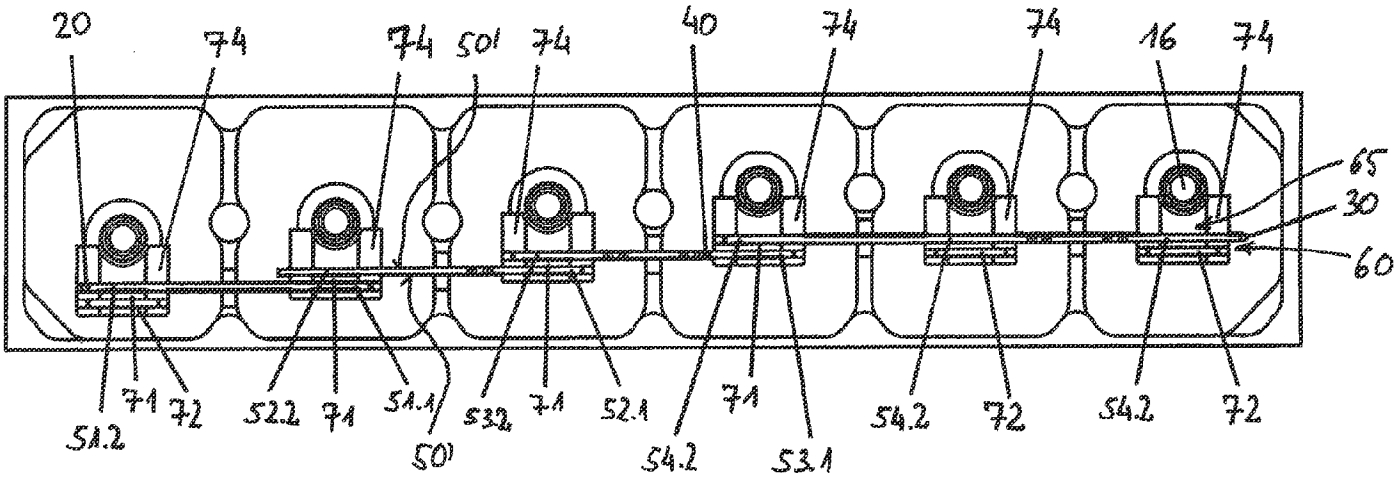
Figure 9:
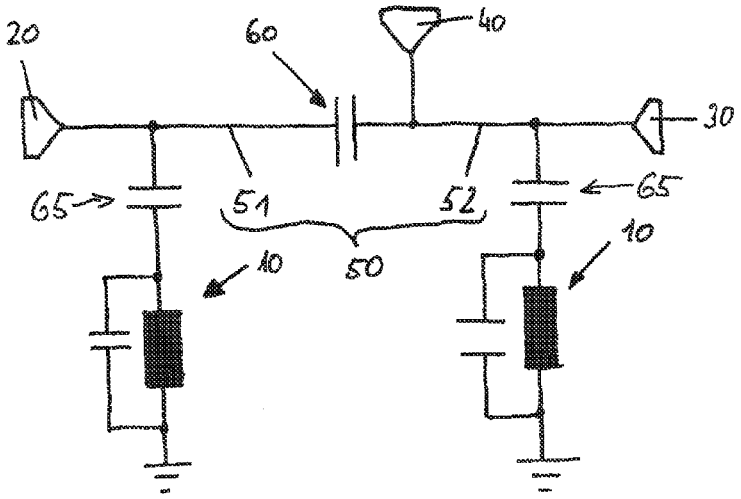
Figure 10:
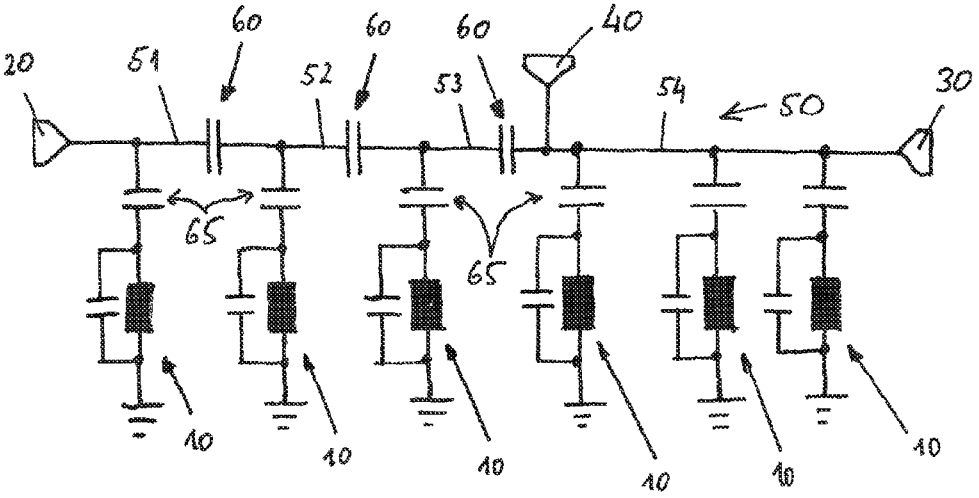

FIG. 5 is a three-dimensional drawing of the radio-frequency blocking filter according to the invention having an input terminal, an output terminal and a transceiver terminal;

FIG. 6 shows the radio-frequency blocking filter shown in FIG. 5 without holding and/or receiving devices;

FIG. 7 is a side view along a longitudinal section of the radio-frequency blocking filter shown in FIGS. 5 and 6;

FIG. 8 is a plan view of the radio-frequency blocking filter shown in FIGS. 5 to 7;

FIG. 9 is an equivalent circuit diagram of a radio-frequency blocking filter according to the invention having merely two coupled resonators; and FIG. 10 is an equivalent circuit diagram of the radio-frequency blocking filter shown in FIGS. 1 to 8.

In the following description, like reference numerals denote like components or like features, in such a way that a description made once for one component in reference to one drawing also applies to the remaining drawings, avoiding a repeated description.

In the following, a radio-frequency filter 1 according to the invention of a coaxial construction is disclosed with reference to FIGS. 1 to 10. In the following, this radio-frequency filter 1 is primarily referred to as a radio-frequency blocking filter 1, since it is a blocking filter. It comprises an external conductor housing, having a housing base 11 and a housing cover 12 (merely shown in FIG. 7) arranged at a distance from and opposing the housing base 11. The external conductor housing comprises the resonator interior 10*a*. In the other drawings, the radio-frequency blocking filter is shown with the housing cover 12 removed. A housing wall 13 is provided peripherally between the housing base 11 and the housing cover 12. The radio-frequency blocking filter 1 shown in FIGS. 1 to 8 comprises six resonators 10, which are each separated from one another by partition walls 14.

The six resonators 10 each comprise an internal conductor 16, the internal conductors 16 each being galvanically connected to the housing base 11 and extending vertically from the housing base 11 towards the housing cover 12. The external conductor housing may be formed integrally with the internal conductors 16, for example as a milled, turned or cast part.

As can be seen from FIGS. 1, 4*a* and 4*b*, the respective internal conductors 16 each end at a distance from the housing cover 12. Alternatively, the respective internal conductors 16 may each extend as far as the housing cover 12, in which case they have to be galvanically separated from the housing cover 12 by an insulation layer.

It can be seen from FIGS. 5 to 8 that the radio-frequency blocking filter 1 comprises an input terminal 20, an output terminal 30 and a further terminal 40 in the form of a transceiver terminal 40. This transceiver terminal thus has a two-way functionality as an output and input terminal. The input terminal 20, the output terminal 30 and the transceiver terminal 40 are coupled together, in other words interconnected, by way of a (continuous) connection line 50, also referred to in the following as a signal line 50. Corresponding radio-frequency signals in the pass band are transmitted via this signal line, and this is how the pass band is ultimately set or defined. The resonators further generate the radio-frequency blocking frequency, in other words the band-stop, in the frequency range of which signal transmission is not possible. The transceiver terminal 40 is arranged between the input terminal 20 and the output terminal 30. As can be seen from FIG. 7, the input terminal 20, the output terminal 30 and the transceiver terminal 40 are each formed as a coaxial terminal, the respective external conductors being galvanically connected to the external conductor housing and the respective internal conductors being galvanically connected to the connection line 50.

In the described blocking filter, the resonators are conventionally not coupled directly, but merely via the signal line 50. Preferably the individual resonators are each in the correct phase, for example being capacitively coupled. In an optimum arrangement, it is thus possible to tune or alter the individual blocking pole frequencies of a respective resonator without influencing the remaining blocking poles (resonators).

As can be seen from the drawings, for example from FIG. 5, 6, 7, 8, 9 or 10, the signal line 50 leads from the input terminal 20 positioned closer to one end of the radio-frequency blocking filter 1 to the output terminal 30 positioned adjacent to the opposite end of the blocking filter 1, through all of the resonators 10, in other words through all of the resonator interiors 10*a*. For this purpose, recesses or openings 14*a*, through which the connection line 50 extends (galvanically separated from the partition walls 40), are formed in the partition walls 40, which separate the individual resonators from one another, in the region of and at the level of the connection line 50.

In the embodiment shown, the connection line 50 comprises three galvanic separation points, which galvanically separate the four line portions 51, 52, 53, 54 of the connection line 50 from one another. In each case a capacitive (as explained in greater detail in the following) separation point 60' is formed. The line portion 51 comprises a first coupling face 51.1 facing the output terminal 30 and a second coupling face 51.2 facing the input terminal 20. The line portion 52 comprises a first coupling face 52.1 facing the output terminal 30 and a second coupling face 52.2 facing the input terminal 20. The line portion 53 comprises a first coupling face 53.1 facing the output terminal 30 and a second coupling face 53.2 facing the input terminal 20. The line portion 54 in turn comprises three second coupling faces 54.2.

The respective first coupling faces 51.1, 52.1, 53.1 and second coupling faces 51.2, 52.2, 53.2 and 54.2 extend in parallel with a longitudinal extension of the outer conductor housing of the radio-frequency blocking filter 1. It can be seen in particular from FIGS. 2 and 8 that the line portions 51, 52, 53, 54 extend so as to be mutually parallel and are arranged so as to be mutually offset in such a way that the first coupling face 51.1 of the line portion 51 opposes the second coupling face 52.2 of the line portion 52. Because the first coupling face 51.1 opposes the second coupling face 52.2, these two coupling faces form a capacitive separation point 60' in the form of a first coupling capacitor 60, which is arranged between the two line portions 51 and 52 at this capacitive separation point and which capacitively interconnects the two resonators 10 shown furthest to the left in the drawings.

Because the aforementioned line portions 51, 52, 53, 54 extend not only mutually so as to be parallel but also in parallel with the longitudinal extent of the external conductor housing, in other words in parallel with the long housing walls 13, and the individual line portions 51, 52, 53, 54 are positioned in parallel and so as to be mutually offset in the region of the capacitive separation points so as to form a small coupling distance, this results in an arrangement as shown in a plan view in FIG. 8. In other words, in the first resonators positioned on the left in FIG. 8, the distance between the lateral housing wall 3 positioned below in FIG. 8 and a downstream capacitive separation point 60' is increased by the thickness of the coupling distance. At the same time a distance between the corresponding line portion and the lateral housing wall 13 positioned above in FIG. 8 is reduced by the same amount. However, since the coupling distances between the individual line portions and the respective internal conductors 16 remain the same (are intended to be the same), it can also be seen from FIG. 8 that, from the first to the fourth resonator, the internal conductor is located in a different relative position between the two parallel housing walls 13 extending in the longitudinal direction. The internal conductors thus implement the same lateral offset with which the line portions arranged in sequence are arranged with the lateral offset in question from one another as determined by the coupling portion.

The first coupling face 52.1 of the line portion 52 opposes the second coupling face 53.2 of the line portion 53 in such a way that the first coupling face 52.1 and the second coupling face 53.2 form a further coupling capacitor 60, which capacitively couples together the second and third resonators 10 from the left in the drawings.

Further, the first coupling face 53.1 of the line portion 53 is arranged opposing the second coupling face 54.2 of the line portion 54, in such a way that the first coupling face 53.1 and the second coupling face 54.2 form a further coupling capacitor 60, which capacitively couples together the third and fourth resonators 10 from the left.

The fourth, fifth and sixth resonators 10 from the left in the drawings are not coupled together via separate coupling capacitors 60, but rather the individual resonators 10 are merely coupled together via the line portion 54.

The line portions 51, 52, 53, 54 each comprise second coupling faces 51.2, 52.2, 53.2, 54.2, which are arranged opposing the respective internal conductors 16 of the resonators 10, in such a way that the respective resonators 10 or the internal conductors 16 are capacitively coupled to the corresponding line portions 51, 52, 53, 54, specifically via the capacitive internal conductor coupling or resonator coupling 65.

It can be seen from the drawings that the radio-frequency blocking filter 1 comprises a number of holding and/or receiving devices 70 corresponding to the number of resonators 10. The positioning of the holding and/or receiving devices 70 in relation to the respective internal conductors 16 of the resonators 10 is shown by way of example in FIGS. 4*a* and 4*b*. The holding and/or receiving device 70 comprises a supporting wall 74, by means of which the holding and/or receiving device 70 is in direct contact with the internal conductor 16, or which is arranged at a small distance from the internal conductor 16. It can also be seen that the corresponding line portions 51, 52, 53, 54 and the respectively associated coupling faces 51.2, 52.2, 53.2, 54.2 of the signal line 50 are arranged at a lateral distance from the respective internal conductors 16 of the resonators 10. Since the corresponding line portions 51, 52, 53, 54 are configured to be strip-shaped, in other words are of a more or less rectangular cross section transverse to the longitudinal direction of the lines (in other words at least having two parallel side faces 50 which in the embodiment shown are also orientated in parallel with the internal conductors), the correspondingly dimensioned cooperating coupling faces are thus formed at the galvanic separation points without any additional measures. In other words, at the galvanic separation points, the line portions form the capacitive separation points 60' having the respectively associated end portions of the line portions which form the coupling faces of a coupling capacitor which is thus formed. The aforementioned holding and/or receiving device 70 is braced on the upper free end 16*a* of the internal conductor 16 and/or fixed to the internal conductor 16. The holding and/or receiving device 70 may be fixed to the internal conductor 16 by gluing, for example.

It can be seen from the drawings that the holding and/or receiving device 70 comprises two receiving spaces 72, 73, which are separated from one another by a partition wall 71. The first coupling face 52.1 of the line portion 52 is arranged in a first receiving space 72 of the holding and/or receiving device 70, whilst the second coupling face 53.2 of the line portion 53 is arranged in a second receiving space 73 of the holding and/or receiving device 70.

Thus, the line portions 51, 52, 53, 54 are each arranged in the region of the upper free ends 16*a* of the corresponding internal conductors 16. It can be seen from the drawings that in this case the vertical portions, extending in parallel with the internal conductor, of the line portions likewise extend from the upper free end 16*a* of the internal conductor 16 downwards towards the housing base 11 over a particular vertical distance in parallel with the internal conductor 16, but preferably only in a region of no more than 10% or 20% or up to 30% of the axial length of the internal conductor. In this vertical region in relation to the internal conductor 16, the aforementioned recesses or openings 14*a* are thus formed in the partition walls 14, whereby the connection line extends at the same level or at the same distance with respect to the housing cover 12 or the housing base.

The holding and/or receiving device 70 preferably consists of a dielectric material, in particular a plastics material. After the respective holding and/or receiving devices 70 are applied to the respective internal conductors 16, the respective line portions 51, 52, 53, 54 are inserted from above into the corresponding receiving spaces 72, 73, formed as receiving pouches, while the housing cover 12 is removed. As a result, the line portions 51, 52, 53, 54 can be positioned with respect to one another and to the internal conductors 16 in a very simple manner, in such a way that the desired resonance properties of the respective resonators 10, and thus the filter properties of the radio-frequency blocking filter 1, are always achieved in a relatively simple manner, since the positions of the line portions are determined by the holding and/or receiving device 70.

It can be seen from the drawings that the respective second coupling faces 51.2, 52.2, 53.2 and 54.2 are arranged opposing the respective internal conductors 16. As a result, the resonators 10 (and/or the internal conductors 16) are capacitively coupled to the respective line portions 51, 52, 53, 54 (capacitive internal conductor coupling and/or resonator coupling 65). In each case, a supporting wall 74 (FIG. 4*b*)—engaging in part over the upper end of an internal conductor 16 (adjacent to the housing cover 12)—of a corresponding holding and/or receiving device 70 is arranged between the second coupling faces 51.2, 52.2, 53.2, 54.2 and the respective internal conductors 16. Since the supporting wall 74 consists of a dielectric material, the capacitive coupling 65 (in other words the capacitive internal conductor coupling 65, sometimes also referred to as the capacitive resonator coupling 65) of the respective second coupling face 51.2, 52.2, 53.2, 54.2 to the internal conductors 16 is influenced by the material selection of the supporting wall 74.

As a result of the overall construction, the mutual coupling of the resonators 10 used in the blocking filter is not achieved by way of a direct coupling between the resonators, but merely via the signal line 50. Therefore, there also no coupling windows or coupling apertures, such as are otherwise conventional, provided between the individual resonators. The resonators are thus preferably each coupled via the signal line 50 in the correct phase, for example by way of the capacitive coupling. In an optimum arrangement, the individual blocking pole frequencies can thus be tuned or altered without influencing the remaining blocking poles. In other words, the described construction according to the invention of the radio-frequency blocking filter thus conventionally comprises a plurality of coaxial resonators 10, the signal line 50 extending between two terminals 20, 30, 40 so as to be adjacent to and for example capacitively coupled to the internal conductors 10 of these resonators.

The resonators 10 of the radio-frequency blocking filter 1 shown in FIGS. 1 to 8 are formed in such a way that the radio-frequency blocking filter 1 is a duplex filter 1. FIG. 10 shows an equivalent circuit diagram of the radio-frequency blocking filter 1 shown in FIGS. 1 to 8. The transceiver terminal 40 can be connected to an antenna (not shown in the drawings). Via the antenna (not shown), it is possible both to transmit output signals and to receive received signals. A transmitter (not shown in the drawings) may be connected to the input terminal 20, and a receiver (not shown in the drawings) may be connected to the output terminal 30.

E-GSM signals used in mobile communications use the frequency range of 880 to 915 MHz for uplink and the frequency range of 925 to 960 MHz for downlink. In this example, the transmitter therefore operates in the frequency range of 880 to 915 MHz. In this case, the duplex filter 1 is formed such that the three resonators 10 between the input terminal 20 and the transceiver terminal 40 are configured in such a way, in terms of the size and geometry thereof, that these three coupled resonators 10 allow through signals in the frequency range of 880 to 915 MHz, but strongly attenuate signals in the frequency range of 925 to 960 MHz. In turn, the three resonators 10 between the output terminal 30 and the transceiver terminal 40 are configured in such a way, in terms of the size and geometry thereof, that they allow through signals in the frequency range of 925 to 960 MHz, whilst signals in the frequency range of 880 to 915 MHz are strongly attenuated, or in other words blocked.

As a result, a signal introduced to the duplex filter by the transmitter via the input terminal 20 is passed on to the transceiver terminal 40, whilst this signal is attenuated by the three resonators 10 between the transceiver terminal 40 and the output terminal 30, in such a way that the signal does not reach the output terminal 30. The signal fed into the duplex filter 1 by the transmitter is emitted via the antenna (not shown), but does not reach the receiver (not shown) of the radio-frequency blocking filter 1 thus formed via the output terminal 30. In other words, this means that a pass range or pass band along the signal line 50 is provided, by way of which for example the receiving signals receives by an antenna or the radio-frequency frequency band received by the antenna can be transmitted from the transceiver terminal 40 at the output terminal 30 to a receiver (not shown in greater detail), whilst as regards the transmission operation a corresponding radio-frequency frequency band is transmitted from an input terminal 20 to the transceiver terminal 40, and supplied to an antenna connected there (not shown in greater detail), meaning that the corresponding signals can thus be transmitted in transmission operation. The receiving branch is thus separated from the transmission branch by the corresponding radio-frequency blocking bands or blocking ranges, preventing overcoupling.

Signals in the range of 925 to 960 MHz received by the antenna are fed into the duplex filter 1 via the transceiver terminal 40. These signals are passed on to the receiver via the three resonators 10 between the transceiver terminal 40 and the output terminal 30. However, these signals are attenuated so strongly by the three resonators between the transceiver terminal 40 and the input terminal 20 that they do not reach the transmitter via the input terminal 20.

In the example, the transmitter operates in the frequency range of 880 to 915 MHz. The distance of the coupling-in points of adjacent resonators with respect to the connection line 50 has to be a distance of $\lambda/4$ of the average frequency of this frequency band. By contrast, the three resonators 10 facing the output terminal 30, which are arranged between the transceiver terminal 40 and the output terminal 30, have a pass band of 925 to 960 MHz, in such a way that the distance of the coupling points of adjacent resonators 10 with respect to the connection line 50 is smaller, in such a way that the connection lines or the corresponding line portions between the respective resonators can be configured shorter than in the resonators 10 facing the transmitter.

To shorten the line portions 51, 52 and 53, the above-described coupling capacitors 60 are arranged between them. These coupling capacitors 60 bring about a phase shift in the signal. The total of this phase shift and the phase shift corresponding to the transit time of the signal via the line portions 51, 52, 53 is equivalent to the phase shift of an electric line having a length of for example $\lambda/4$ of the average-frequency signal.

The line portion 54 which couples together the three resonators 10 between the transceiver terminal 40 and the output terminal 30 has no corresponding coupling capacitors 60, since the distance of the coupling point of two adjacent resonators 10 from the coupling portion 54 is smaller, in such a way that no coupling capacitor 60 has to be used for effectively lengthening the line portion 54. However, it can be seen from FIGS. 1, 3 and 5 to 7 that the line portion 54 is formed wavy rather than straight, in such a way that the distances of the coupling points of two adjacent resonators 10 are in fact $\lambda/4$ for average-frequency signals in the band from 925 to 960 MHz.

From FIGS. 2 and 8, it can be seen that the respective internal conductors 16 of the resonators 10 are each at different distances from the housing wall 13. This is partly because the individual line portions 51, 52, 53, 54 can be implemented in a particularly geometrically simple manner as a result using straight lines or plates. On the other hand, it is because the respective resonators are to have different resonant frequencies, which differ from one another, in such a way that a correspondingly wider blocking range (in terms of frequency width) can be achieved.

FIG. 9 is an equivalent circuit diagram of a radio-frequency blocking filter according to the invention having a continuous signal line 50 (and having the coupling capacitor 60 connected in the continuous signal line 50), which filter merely has two resonators 10, which are capacitively interconnected via a coupling capacitor 60. A corresponding radio-frequency blocking filter 1 or a corresponding duplex filter 1 has narrower blocking ranges for uplink and downlink, since merely one resonator 10 is provided for uplink and downlink. However, the remaining functionality of the radio-frequency blocking filter 1 shown in FIG. 9 is identical to the functionality of the radio-frequency blocking filter 1 disclosed with reference to FIGS. 1 to 8 and 10.

From the above description, it can thus be seen that in the described radio-frequency blocking filter the useful signal transmission takes place via the connection line 50 from an input to a respective output, the connection line additionally, in the context of the invention, being capacitively coupled to the resonators 10, in other words to the internal conductors 16, by approaching them. As a result of the galvanic separation points in the form of capacitive separation points, provided in relation to the connection line, the total length of the connection line 50 is effectively shortened, meaning that the radio-frequency blocking filter is also comparatively compact at low radio-frequencies. Without the aforementioned capacitive separation points, the line length between two resonators 10 would be approximately $\lambda/2$. In the context of the invention, this line length is much shorter.

For the described blocking filter, with coupling in the correct phases, the desired blocking poles, located outside the transmission frequency range, are provided. The blocking pole coupling in the correct phases can be set appropriately by way of an optimised combination of the individual line lengths between the capacitive separation points and the value of the capacitors at the separation points themselves.

The invention claimed is:

1. Radio-frequency blocking filter of a coaxial construction, comprising:

an external conductor housing having a housing base and a housing cover arranged at a distance from and opposing the housing base, between which a housing wall is provided peripherally;

at least two resonators, each comprising an internal conductor;

the internal conductors each galvanically connected to the housing base and extending from the housing base towards the housing cover;

the internal conductors each ending at a distance from the housing cover and/or galvanically separated from the housing cover, an input terminal and an output terminal, the signal line being galvanically connected or capacitively coupled to the input terminal and to the output terminal, the signal line extending through the resonators of the radio-frequency blocking filter past the internal conductors to form capacitive internal conductor couplings and/or resonator couplings, the signal line comprising at least one galvanic separation point in the form of a capacitive separation point, the capacitive separation point being disposed at a distance from and capacitively coupled to the internal conductors, and the resonators or internal conductors each being capacitively coupled to the signal line, wherein, at the capacitive separation point, the galvanically separated signal line in each case comprises a first coupling face and a second coupling face, whereby two galvanically separated portions of the signal line are capacitively interconnected.

2. Radio-frequency blocking filter according to claim 1, wherein the at least one capacitive separation point is provided in the signal line at a lateral distance from a said internal conductor, in a region in front of an upper end of the said internal conductor.

3. Radio-frequency blocking filter according to claim 1, wherein the signal line is configured to be strip-shaped, having a rectangular cross section with respect to a direction of extension.

4. Radio-frequency blocking filter according to claim 1, wherein the internal conductors are each formed as internal conductor tubes.

5. Radio-frequency blocking filter according to claim 1, wherein:

the signal line comprises at least first and second line portions which are galvanically separated from one another at the capacitive separation point of the signal line;

the first line portion being galvanically connected and/or capacitively coupled to the input terminal and comprising a first coupling face;

the second line portion being galvanically connected and/or capacitively coupled to the output terminal and comprising a second coupling face; and the first coupling face and the second coupling face of the capacitive separation point opposing one another at least in part, in such a way that the first coupling face and the second coupling face form a coupling capacitor.

6. Radio-frequency blocking filter according to claim 1, wherein:

the radio-frequency blocking filter further comprises a holding and/or receiving device, which is braced on a said internal conductor and/or fixed to the said internal conductor, and two receiving spaces, which are separated from one another by a partition wall; and the first coupling face is arranged in a first receiving space of the holding and/or receiving device, and the second coupling face is arranged in a second receiving space of the holding and/or receiving device.

7. Radio-frequency blocking filter according to claim 6, wherein:

the second coupling face is arranged opposing the internal conductors, in such a way that the respective internal conductors and/or resonators are capacitively coupled to respective line portions so as to form a capacitive internal conductor coupling and/or resonator coupling, and a supporting wall of the holding and/or receiving device is arranged between the respective second coupling faces and the respective internal conductors.

8. Radio-frequency blocking filter according to claim 1, wherein the resonators are of different sizes.

9. Radio-frequency blocking filter according to claim 1, wherein at least some internal conductors of the respective resonators are at different distances from the housing wall.

10. Radio-frequency blocking filter according to claim 1, wherein line portions of the signal line are oriented in parallel with the housing wall extending in the longitudinal direction, and at least two line portions in series are arranged with a lateral offset from one another so as to form a coupling distance in the region of the capacitive separation point, and the internal conductors which are coupled in this way are arranged so as to be offset from one another by a corresponding lateral offset with respect to the housing wall.

11. Radio-frequency blocking filter according to claim 1, wherein the housing cover comprises a circuit board, of which the inside of the resonator is metal-coated.

12. Radio-frequency blocking filter according to claim 1, wherein the external conductor housing is formed integrally with the internal conductors, as a milled, turned or cast part.

13. Radio-frequency blocking filter according to claim 1, wherein the external conductor housing and/or the internal conductor consist of plastics material, the respective inner surfaces being metal-coated.

14. Radio-frequency blocking filter according to claim 1, wherein:

the radio-frequency blocking filter further comprises a further terminal;

the further terminal is arranged between the input terminal and the output terminal and is galvanically connected to the signal line; and the further terminal is arranged together with the signal line between coupling points of the internal conductors or resonators.

15. Radio-frequency according to claim 14, wherein the resonators are configured and coupled in such a way that a duplex filter is formed.

16. Radio-frequency blocking filter according to claim 14, wherein:

at least two resonators are capacitively coupled to the signal line between the further terminal and the input terminal; and at least two resonators are capacitively coupled to the signal line between the further terminal and the output terminal.

17. Radio-frequency blocking filter according to claim 1, wherein the radio-frequency blocking filter operates with the blocking range and pass-band range thereof between 790 MHz and 862 MHz and/or in the range between 880 MHz and 960 MHz and/or in the range of the 1800 MHz mobile radio frequency and/or the 2000 MHz mobile radio frequency.

18. Radio-frequency blocking filter of a coaxial construction, comprising:

an external conductor housing having a housing base and a housing cover arranged at a distance from and opposing the housing base, between which a housing wall is provided peripherally;

at least first and second resonators each comprising an internal conductor formed as an internal conductor tube;

the first and second internal conductors each galvanically connected to the housing base and extending from the housing base towards the housing cover;

the first and second internal conductors each ending at a distance from the housing cover and/or galvanically separated from the housing cover, an input terminal and an output terminal, a signal line galvanically connected or capacitively coupled to the input terminal and to the output terminal, the signal line extending through the resonators of the radio-frequency blocking filter past a respective said internal conductor so as to form a capacitive internal conductor coupling and/or resonator coupling, the signal line comprising at least one capacitive separation point, the capacitive separation point being disposed at a distance from and capacitively coupled to the internal conductors, and the resonators or internal conductors each being capacitively coupled to the signal line.

19. Radio-frequency blocking filter of a coaxial construction, comprising:

an external conductor housing having a housing base and a housing cover arranged at a distance from and opposing the housing base, between which a housing wall is provided peripherally;

at least first and second resonators each comprising an internal conductor;

the internal conductors each galvanically connected to the housing base and extending from the housing base towards the housing cover;

the internal conductors each ending at a distance from the housing cover and/or being galvanically separated from the housing cover, an input terminal and an output terminal, a signal line being galvanically connected or capacitively coupled to the input terminal and to the output terminal, the signal line extending through the resonators of the radio-frequency blocking filter past a respective said internal conductor so as to form a capacitive internal conductor coupling and/or resonator coupling, the signal line comprising a capacitive separation point, the capacitive separation point being disposed at a distance from and capacitively coupled to the internal conductors, the resonators or internal conductors each being capacitively coupled to the signal line, wherein:

the signal line comprises at least first and second line portions which are galvanically separated from one another at the capacitive separation point of the signal line;

the first line portion being galvanically connected and/or capacitively coupled to the input terminal and comprising a first coupling face;

the second line portion being galvanically connected and/or capacitively coupled to the output terminal and comprising a second coupling face;

the first coupling face and the second coupling face of the capacitive separation point opposing one another at least in part, in such a way that the first coupling face and the second coupling face form a coupling capacitor.

20. Radio-frequency blocking filter according to claim 19, wherein the first and second line portions are arranged in parallel and so as to be mutually offset and the first coupling faces and the second coupling faces are arranged in parallel and so as to be mutually offset.

21. Radio-frequency blocking filter according to claim 19, wherein a partition wall comprising a dielectric material is arranged between the first coupling face and the second coupling face.

* * * * *